US007326026B2

(12) United States Patent
Stender et al.

(10) Patent No.: US 7,326,026 B2
(45) **Date of Patent: *Feb. 5, 2008**

(54) LOADER ASSEMBLY, METHOD FOR USING A LOADER ASSEMBLY, AND COMBINATION MOTOR VEHICLE AND LOADER ASSEMBLY

(75) Inventors: James Curtis Stender, Schleswig, IA (US); Joseph W. Langenfeld, Onawa, IA (US); Neal W. Westendorf, Dakota Dunes, SD (US)

(73) Assignee: Westendorf Manufacturing, Co., Onawa, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/348,692

(22) Filed: Feb. 6, 2006

(65) Prior Publication Data

US 2006/0182592 A1 Aug. 17, 2006

Related U.S. Application Data

(63) Continuation of application No. 10/774,064, filed on Feb. 6, 2004, now Pat. No. 6,994,512.

(51) Int. Cl.
*E02F 3/627* (2006.01)

(52) U.S. Cl. ..... 414/686; 414/918

(58) Field of Classification Search ..... 414/686, 414/680, 918, 800

See application file for complete search history.

(56) References Cited

U.S. PATENT DOCUMENTS 2,326,338 A 8/1943 Drott et al.

(Continued)

OTHER PUBLICATIONS

"Kubota Diesel Tractor", Catalog No. 3079-01-US, 12 Pages, Feb. 1990.

(Continued)

*Primary Examiner*—Donald Underwood
(74) *Attorney, Agent, or Firm*—Merchant & Gould, P.A.

(57) ABSTRACT

A loader assembly is provided having a left boom arm and a right boom arm. The left boom arm includes a left tower, a left loader arm, a left lift cylinder, and a left attachment cylinder. The left tower is constructed for attachment to a bracket on a motor vehicle. The left loader arm includes a first end rotatably attached to the left tower, a second end constructed for attaching to an attachment, and a left lift cylinder/attachment cylinder rotation pin. The left lift cylinder includes a first end rotatably attached to the left tower, and a second end rotatably attached to the left loader arm at the left lift cylinder/attachment cylinder rotation pin. The left attachment cylinder includes a first end rotatably attached to the left loader arm at the left lift cylinder/attachment cylinder rotation pin, and a second end constructed for attaching to an attachment. The right boom arm includes a right tower, a right loader arm, a right lift cylinder, and a right attachment cylinder. The right tower is constructed for attachment to a bracket on a motor vehicle. The right loader arm includes a first end rotatably attached to the right tower, a second end constructed for attaching to an attachment, and a right lift cylinder/attachment cylinder rotation pin. The right lift cylinder includes a first end rotatably attached to the right tower, and a second end rotatably attached to the right loader arm at the right lift cylinder/attachment cylinder rotation pin. The right attachment cylinder includes a first end rotatably attached to the right loader arm at the right lift cylinder/attachment cylinder rotation pin, and a second end constructed for attaching to an attachment. The loader assembly can include a tower subframe extending between the left boom arm and the right boom arm, and the tower subframe can be provided for conveying hydraulic lines between the left boom arm and the right boom arm. A combination motor vehicle and loader assembly and a method for using a loader assembly are provided.

2 Claims, 9 Drawing Sheets

U.S. PATENT DOCUMENTS

| | | | | |
|---|---|---|---|---|
| 2,812,595 | A | 11/1957 | Drott et al. | |
| 3,077,999 | A | 2/1963 | Svoboda | |
| 3,209,474 | A | 10/1965 | Artman | |
| 3,243,905 | A | 4/1966 | Ulrich | |
| 3,344,540 | A | 10/1967 | Ulrich | |
| 3,455,477 | A | 7/1969 | Blair | |
| 3,512,665 | A | 5/1970 | Westendorf | |
| 3,701,443 | A | 10/1972 | Lely | |
| 3,982,643 | A | 9/1976 | MacGregor et al. | |
| 3,991,890 | A | 11/1976 | Frank | |
| 4,033,469 | A | 7/1977 | Frank | |
| 4,051,962 | A | 10/1977 | Westendorf | |
| 4,085,856 | A | 4/1978 | Westendorf | |
| 4,345,870 | A | 8/1982 | Anderson et al. | |
| 4,538,955 | A | 9/1985 | Langenfeld et al. | |
| 4,565,485 | A | 1/1986 | Wilman | |
| 4,566,844 | A | 1/1986 | Campin | |
| 4,606,692 | A | 8/1986 | Langenfeld et al. | |
| 4,787,811 | A | 11/1988 | Langenfeld et al. | |
| 4,790,084 | A | 12/1988 | Anderson et al. | |
| 4,797,051 | A | 1/1989 | Langenfeld et al. | |
| 4,798,511 | A | 1/1989 | Kaczmarczyk et al. | |
| 4,859,130 | A | 8/1989 | Langenfeld et al. | |
| 4,890,400 | A | 1/1990 | Long | |
| 4,915,575 | A | 4/1990 | Langenfeld et al. | |
| 4,930,974 | A | 6/1990 | Langenfeld et al. | |
| 4,968,213 | A | 11/1990 | Langenfeld et al. | |
| 4,995,760 | A | 2/1991 | Probst et al. | |
| 5,121,557 | A | 6/1992 | Moore | |
| 5,232,330 | A | 8/1993 | Rae et al. | |
| 5,387,076 | A | 2/1995 | Fuzzen | |
| 5,466,113 | A | 11/1995 | Norberg | |
| 5,785,328 | A | 7/1998 | Eckloff | |
| 5,997,237 | A | 12/1999 | Langenfeld et al. | |
| 6,142,724 | A | 11/2000 | Hirooka et al. | |
| 6,171,050 | B1 * | 1/2001 | Johnson | 414/685 |
| D459,368 | S | 6/2002 | Westendorf et al. | |
| 6,582,177 | B1 | 6/2003 | Westendorf et al. | |
| 6,663,337 | B2 | 12/2003 | Westendorf et al. | |
| 6,994,511 | B2 * | 2/2006 | Westendorf et al. | 414/686 |
| 2003/0210972 | A1 * | 11/2003 | Yukawa et al. | 414/394 |

OTHER PUBLICATIONS

"Bush Hog Front End Loaders", 12 Pages, date unknown.
"Bush Hog QT Series Front End Loaders", 16 Pages, date unknown.

* cited by examiner

LOADER ASSEMBLY, METHOD FOR USING A LOADER ASSEMBLY, AND COMBINATION MOTOR VEHICLE AND LOADER ASSEMBLY

This application is a continuation of U.S. application Ser. No. 10/774,064 that was filed with the United States Patent and Trademark Office on Feb. 6, 2004, and issued as U.S. Pat. No. 6,994,512 on Feb. 7, 2006. The entire disclosure of U.S. application Ser. No. 10/774,064 is incorporated herein by reference.

FIELD OF THE INVENTION

The invention relates to a loader assembly, a method for using a loader assembly, and a combination motor vehicle and loader assembly. The loader assembly can be constructed to provide a relatively low profile when provided on a motor vehicle such as a tractor. The relatively low profile can be achieved by having the lift cylinders and the attachment cylinders attach to the loader arms at lift cylinder/attachment cylinder rotation pins. In addition, the loader assembly can include a plurality of hydraulic lines extending through a tower subframe to provide connectivity between a left boom arm and a right boom arm. The invention additionally relates to hydraulic cylinders that can be used on a loader assembly.

BACKGROUND OF THE INVENTION

Conventional loader assemblies have a pair of boom assemblies that have rearward ends that attach to a tractor, and forward ends that attach to an attachment. Exemplary attachments found on loader assemblies include buckets, clam shells, plows, fork lifts, bale spears, etc. Hydraulic cylinders are provided for operating the loader assemblies and the attachments.

Exemplary loader assemblies are described by U.S. Pat. No. 3,512,665 to Westendorf; U.S. Pat. No. 4,085,856 to Westendorf; U.S. Pat. No. 4,787,811 to Langenfeld et al.; U.S. Pat. No. 4,051,962 to Westendorf; U.S. Pat. No. 4,606,692 to Langenfeld et al.; U.S. Pat. No. 4,930,974 to Langenfeld et al.; and U.S. Pat. No. 6,582,177 to Westendorf et al.

Hydraulic lines that power the hydraulic cylinders on loader assemblies are often found extending along the exterior of the loader assemblies. When the hydraulic lines are exposed along the exterior of the loader assembly, there is an increased likelihood that the hydraulic lines may become damaged.

Efforts have been undertaken to improve the power of loader assemblies and to provide loader assemblies that are more aesthetically appealing and more closely follow the design lines of the motor vehicle to which they are attached.

SUMMARY OF THE INVENTION

A loader assembly is provided according to the invention. The loader assembly includes a left boom arm and a right boom arm. The left boom arm includes a left tower, a left loader arm, a left lift cylinder, and a left attachment cylinder. The left tower is constructed for attachment to a bracket on a motor vehicle. The left loader arm includes a first end rotatably attached to the left tower, a second end constructed for attaching to an attachment, and a left lift cylinder/attachment cylinder rotation pin. The left lift cylinder includes a first end rotatably attached to the left tower, and a second end rotatably attached to the left loader arm at the left lift cylinder/attachment cylinder rotation pin. The left attachment cylinder includes a first end rotatably attached to the left loader arm at the left lift cylinder/attachment cylinder rotation pin, and a second end constructed for attaching to an attachment. The right boom arm includes a right tower, a right loader arm, a right lift cylinder, and a right attachment cylinder. The right tower is constructed for attachment to a bracket on a motor vehicle. The right loader arm includes a first end rotatably attached to the right tower, a second end constructed for attaching to an attachment, and a right lift cylinder/attachment cylinder rotation pin. The right lift cylinder includes a first end rotatably attached to the right tower, and a second end rotatably attached to the right loader arm at the right lift cylinder/attachment cylinder rotation pin. The right attachment cylinder includes a first end rotatably attached to the right loader arm at the right lift cylinder/attachment cylinder rotation pin, and a second end constructed for attaching to an attachment.

The loader assembly can include a tower subframe extending between the left boom arm and the right boom arm. The tower subframe can be provided extending from the left tower to the right tower. The tower subframe can include hydraulic lines extending therethrough for powering at least one of the pair of the left lift cylinder and the left attachment cylinder or the right lift cylinder and the right attachment cylinder. The tower subframe can include a left tower subframe arm, a right tower subframe arm, and a tower subframe mounting arm extending between the left tower subframe arm and the right tower subframe arm for attachment to a front bracket on a motor vehicle.

A loader assembly is provided according to the invention that includes a left boom arm, a right boom arm, and a tower subframe. The left boom arm includes a left tower constructed for attaching to a bracket on a tractor, and a left loader arm including a first end rotatably attached to the left tower and a second end constructed for attaching to an attachment. The right boom arm includes a right tower constructed for attaching to a bracket on a tractor, and a right loader arm including a first end rotatably attached to the right tower and a second end constructed for attaching to an attachment. The tower subframe is constructed to contain a plurality of hydraulic lines therein extending between the left boom arm and the right boom arm. The hydraulic lines can be used for powering hydraulic cylinders on the loader assembly. The tower subframe can include a left tower subframe arm extending from the left tower, a right tower subframe arm extending from the right tower, and a tower subframe mounting arm extending between the left tower subframe arm and the right tower subframe arm. The tower subframe mounting arm can be constructed to engage a front bracket on a tractor. The tower subframe can additionally include a tower subframe support extending between the left tower subframe arm and the right tower subframe arm, and hydraulic lines can extend through the tower subframe support.

A combination motor vehicle and loader assembly is provided according to the invention. The motor vehicle can have a left side bracket attached to the left side of the motor vehicle, a right side bracket attached to the right side of the motor vehicle and a front bracket attached to the front of the motor vehicle. The loader assembly can be provided so that the left tower is attached to the left bracket, the right tower is attached to the right bracket, and the tower subframe is attached to the front bracket.

A method for operating a loader assembly is provided according to the invention. The method includes a step of driving a tractor into the loader assembly provided in a storage position until a left bracket and a right bracket on the tractor engage a left tower and a right tower on the loader assembly. The method can additionally include steps of connecting tractor hydraulic lines to loader hydraulic lines to power hydraulic cylinders on the loader assembly, and operating at least a portion of the hydraulic cylinders to cause the tower subframe to engage a front bracket on the tractor.

DETAILED DESCRIPTION OF THE INVENTION

Figure 1:
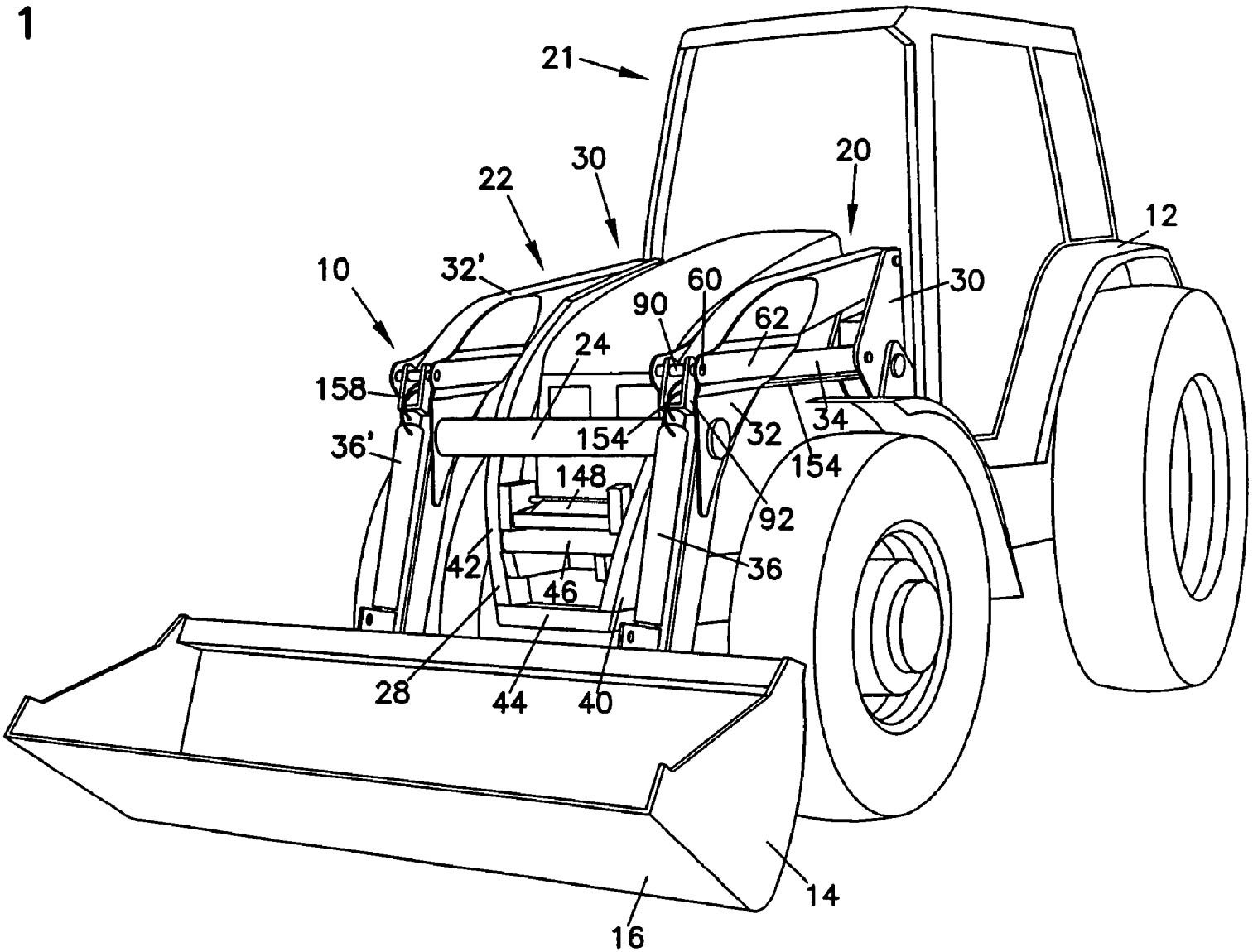
FIG. 1 is a perspective view of a loader assembly on a tractor according to the principles of the present invention.
Figure 2:
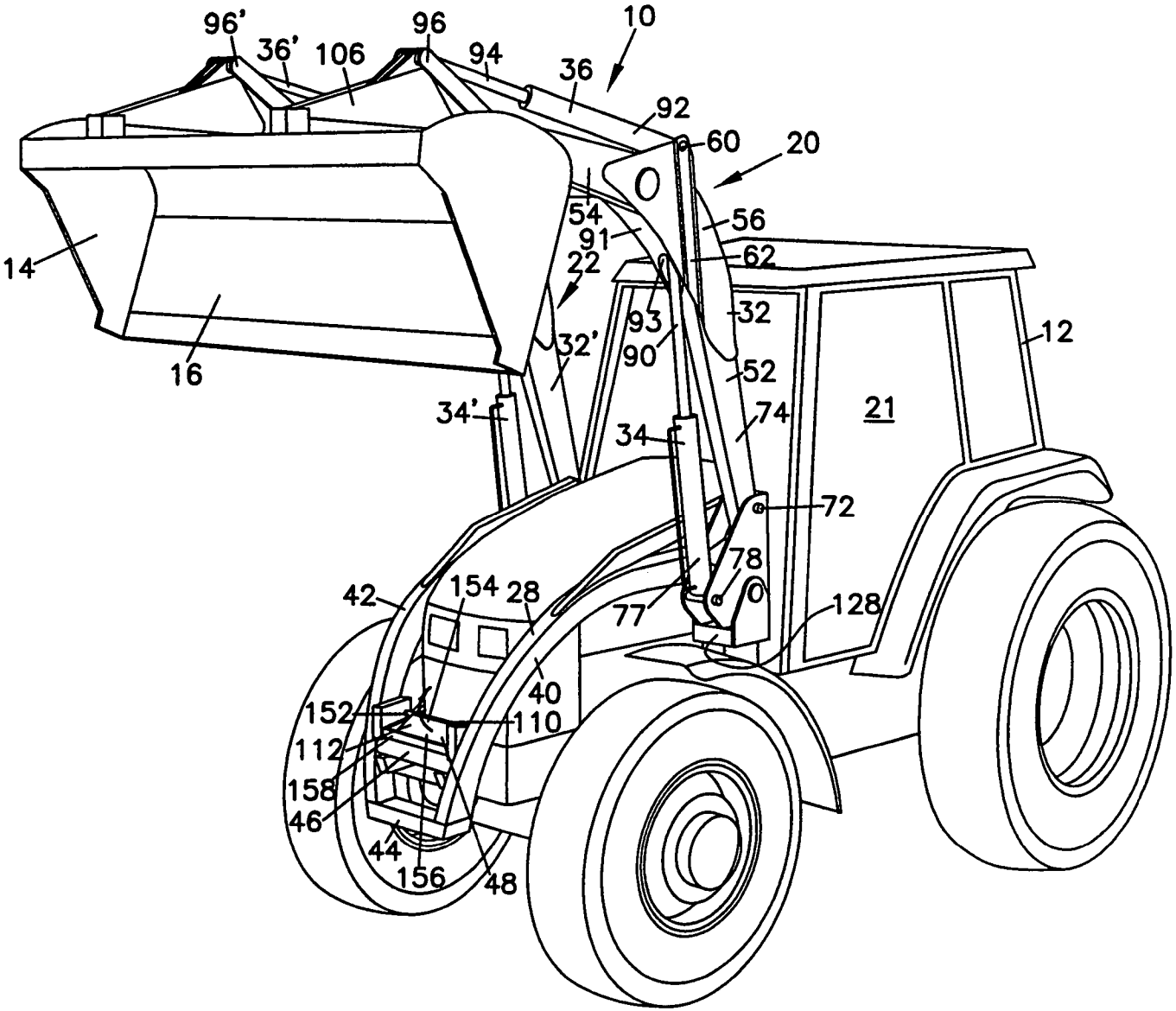
FIG. 2 is a perspective view of the loader assembly on a tractor of FIG. 1 in a dumping position.
Figure 3:
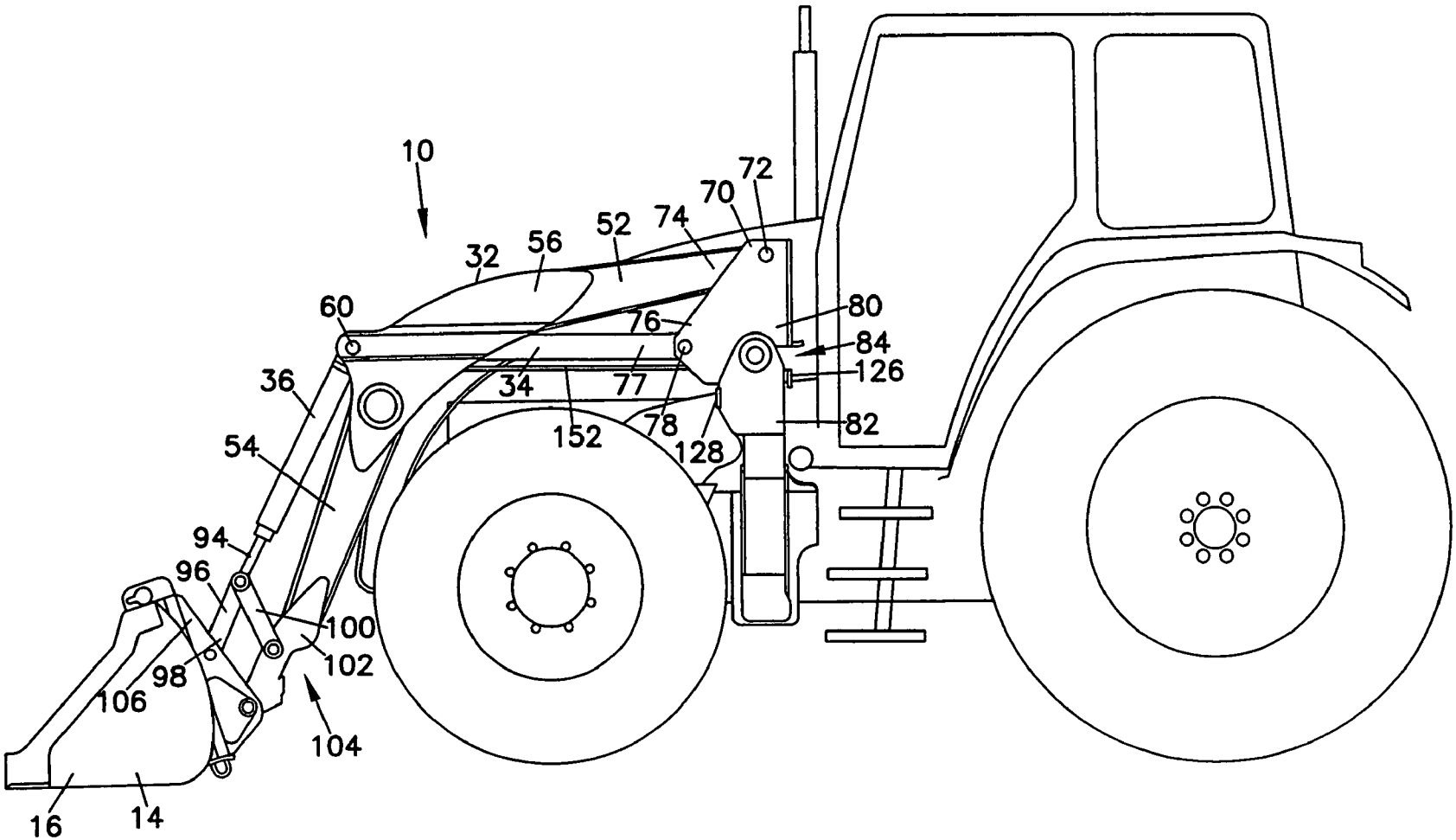
FIG. 3 is a side view of the loader assembly on a tractor of FIG. 1.

A loader assembly according to the invention is shown in FIGS. 1-3 at reference number 10. The loader assembly 10 is shown attached to a tractor 12 and an attachment 14. The attachment is shown as a bucket 16. The attachment 14 can be any other attachment useful on loader assemblies. Exemplary attachments commonly found on loader assemblies include plows, fork lifts, bale spears, clam shell buckets, etc. The loader assembly 10 can be referred to more simply as the loader.

The loader assembly 10 includes a left boom arm 20, and a right boom arm 22 that generally includes structure similar to that provided on the left boom arm 20. The reference to "left" and "right" refer to the side from the perspective of an operator sitting within the operator area 21 of the tractor 12. The left boom arm 20 generally extends along the left side of the tractor 12 and the right boom arm 22 generally extends along the right side of the tractor 12. The left boom arm 20 and the right boom arm 22 can be referred to as the first boom arm 20 and the second boom arm 22. The left boom arm 20 and the right boom arm 22 can be attached together by a stabilizing arm 24. The stabilizing arm 24 can be in the form of a pipe 26. The left boom arm 20 and the right boom arm 22 can be attached together via the tower subframe 28 and via the attachment 14. In general, it is expected that the left boom arm 20 and the right boom arm 22 will operate in unison although it should be understood that a certain amount of bending may occur as a result of an unbalanced load.

The left boom arm 20 and the right boom arm 22 can include similar and different structures. In general, the following discussion will often identify structure that is present on both the left boom arm 20 and the right boom arm 22. A structure identified on the left boom arm 20 will be identified by reference number without an apostrophe and corresponding structure on the right boom arm 22 can be identified with the same reference number but with an apostrophe. For example, the left boom arm 20 includes a tower 30, a loader arm 32, a lift cylinder 34, and an attachment cylinder 36, and the right boom arm 22 includes a tower 30', a loader arm 32', a lift cylinder 34', and an attachment cylinder 36'. It should be appreciated that much of the structure identified on the left boom arm 20 or the right boom 22 will not be specifically identified on the other boom arm although the existence of the structure will be apparent from the drawings.

The loader assembly 10 additionally includes a tower subframe 28 that connects the left boom arm 20 and the right boom arm 22. In addition, the tower subframe 28 provides a conduit for hydraulic lines extending between the left boom arm 20 and the right boom arm 22. The tower subframe 28 includes a left tower subframe arm 40, a right tower subframe arm 42, a tower subframe support 44, a tower subframe mounting arm 46, and a front bracket locking assembly 48.

The loader arm 32 includes an upper arm 52, a lower arm 54, and a knee area 56 in the general area between the upper arm 52 and the lower arm 54. It should be understood that the loader arm 32 can be considered a single structure and the upper arm 52, the lower arm 54, and the knee 56 can be considered general areas of that structure. The loader arm 32 can include a rotation member or pin 60 that can be provided in the knee area 56. The rotation member or pin 60 can be provided for attachment to both the lift cylinder 34 and the attachment cylinder 36. The rotation member or pin 60 can be referred to as the lift cylinder/attachment cylinder rotation pin. The applicants discovered that by allowing the lift cylinder 34 and the attachment cylinder 36 to attach to the loader arm 32 at the rotation member or pin 60, it is possible to provide a loader assembly 10 having a generally lower profile than many prior art loader assemblies while retaining a clearance area over the tires of the tractor 12 and maintaining a sufficiently powerful loader assembly triangle. It should be understood that the loader assembly triangle refers to the triangle created by the points identified by reference numbers 72, 60, and 78. The tractor 12 shown in FIGS. 1-3 is a New Holland TS110 tractor that is configured to provide generally low profile front hood. It should be understood that other types of tractors and other tractor designs can be used according to the invention. The loader assembly 10 can be constructed so that it generally follows the lines of the tractor 12. In addition, the generally lower profile provided by the loader assembly 10 enhances visibility for the operator.

The loader arm 32 can be constructed so that the lift cylinder 34 and the attachment cylinder 36 to attach to the loader arm 32 at the rotation member or pin 60. In order to achieve this, one or both of the lift cylinder 34 and attachment cylinder 36 can extend through at least a portion of the loader arm 32. For the embodiment of the loader assembly shown, the loader arm 32 is constructed to allow the lift cylinder 34 to extend therethrough. The knee area 56 includes a bump out portion 62 that allows the lift cylinder 34 to extend therethrough in order to attach to the rotation member or pin 60. It should be understood that the loader assembly 10 can be constructed without a bump out area 62. For example, the left boom arm and the right boom can be constructed having a sufficient width that allows the lift cylinder to extend there through while retaining a desired strength.

The tower 30 includes a first tower area 70 that includes a tower/loader arm rotation pin 72. The loader arm 32 includes a first end 74 of the upper arm 52 that attaches to the tower 30 at the tower/loader arm rotation pin 72. The tower 30 additionally includes a tower second area 76 that includes a tower/lift cylinder rotation pin 78. The lift cylinder 34 includes a lift cylinder first end 77 that attaches to the tower 30 at the tower/lift cylinder rotation pin 78. The tower 30 additionally includes a third tower area 80 that is constructed to attach to the left side bracket 82 that is attached to the tractor 12. The third tower area 80 includes a bracket receiving area 84 that is constructed to engage the left side bracket 82.

The lift cylinder 34 includes a lift cylinder first end 77 that attaches to the tower 30 at the tower/lift cylinder rotation pin 78, and a lift cylinder second end 90 that attaches to the loader arm 32 at the rotation member or pin 60. The lift cylinder second end 90 extends through the knee area 56. The loader arm 32 can include a bottom surface 91 having an opening 93 through which the lift cylinder second end 90 extends. The attachment cylinder 36 includes an attachment cylinder first end 92 that attaches to the loader arm 32 at the rotation member or pin 60. The attachment cylinder 36 includes an attachment cylinder second end 94 that attaches to the attachment 14. The attachment cylinder second end 94 can either attach directly to the attachment 14 or it can attach to the attachment 14 via a linkage 96. The linkage 96 can be provided to help increase the angle of rotation of the attachment 14. The linkage 96 can include a first linkage arm 98 and a second linkage arm 100. The first linkage arm 98 can attach to the attachment 14, and the second linkage arm 100 can attach to the loader arm second end 102 provided in the lower arm 54. In general, the shape of the loader arm second end 102 can be provided to help increase the angle of rotation of the attachment 14 to achieve, for example, the rotation shown in FIG. 2. For example, when the attachment 14 is a bucket 16, the combination of the linkage 96 and the loader arm second end 102 allows the bucket 16 to rotate backward further than would be possible if the loader arm second end 102 did not include a recessed area 104. It should be understood that the direction "backwards" refers to a counter clockwise rotation of the bucket 16 about the second loader arm end 102 as shown from the perspective in FIG. 3. In other words, a backwards rotation can be characterized as the rotation resulting from the extension of the attachment cylinder 36, and a forward rotation can be considered a rotation resulting from a retraction of the attachment cylinder 36. The use of a linkage and the shape of a loader arm second end are described in U.S. application Ser. No. 10/719,657 that was filed with the United States Patent and Trademark Office on Nov. 21, 2003. The entire disclosure of U.S. application Ser. No. 10/719,657 is incorporated herein by reference.

The linkage 96 or the attachment cylinder 36, can attach directly to the attachment 14 or to a quick attachment device 106 that provides for a relatively quick and convenient attachment and removal of the attachment 14 from the loader assembly 10. Exemplary quick attachment devices are described in U.S. Pat. No. 3,512,665 to Westendorf, U.S. Pat. No. 4,085,856 to Westendorf, U.S. Pat. No. 4,787,811 to Langenfeld et al., U.S. Pat. No. 4,859,130 to Langenfeld et al., U.S. Pat. No. 4,915,575 to Langenfeld et al., and U.S. Pat. No. 4,968,213 to Langenfeld et al. The disclosures of quick attachment devices provided in these patents are incorporated herein by reference. Although the loader assembly 10 is shown having a quick attachment device 106, it should be understood that the invention can be practiced without a quick attachment device. That is, the attachment 14 (such as the bucket 16) can attach directly to the linkage 96 and the loader arm second end 102. In addition, the attachment 14 (such as the bucket 16) can attach directly to the attachment cylinder second end 94 and the loader arm second end 102.

Figure 4:
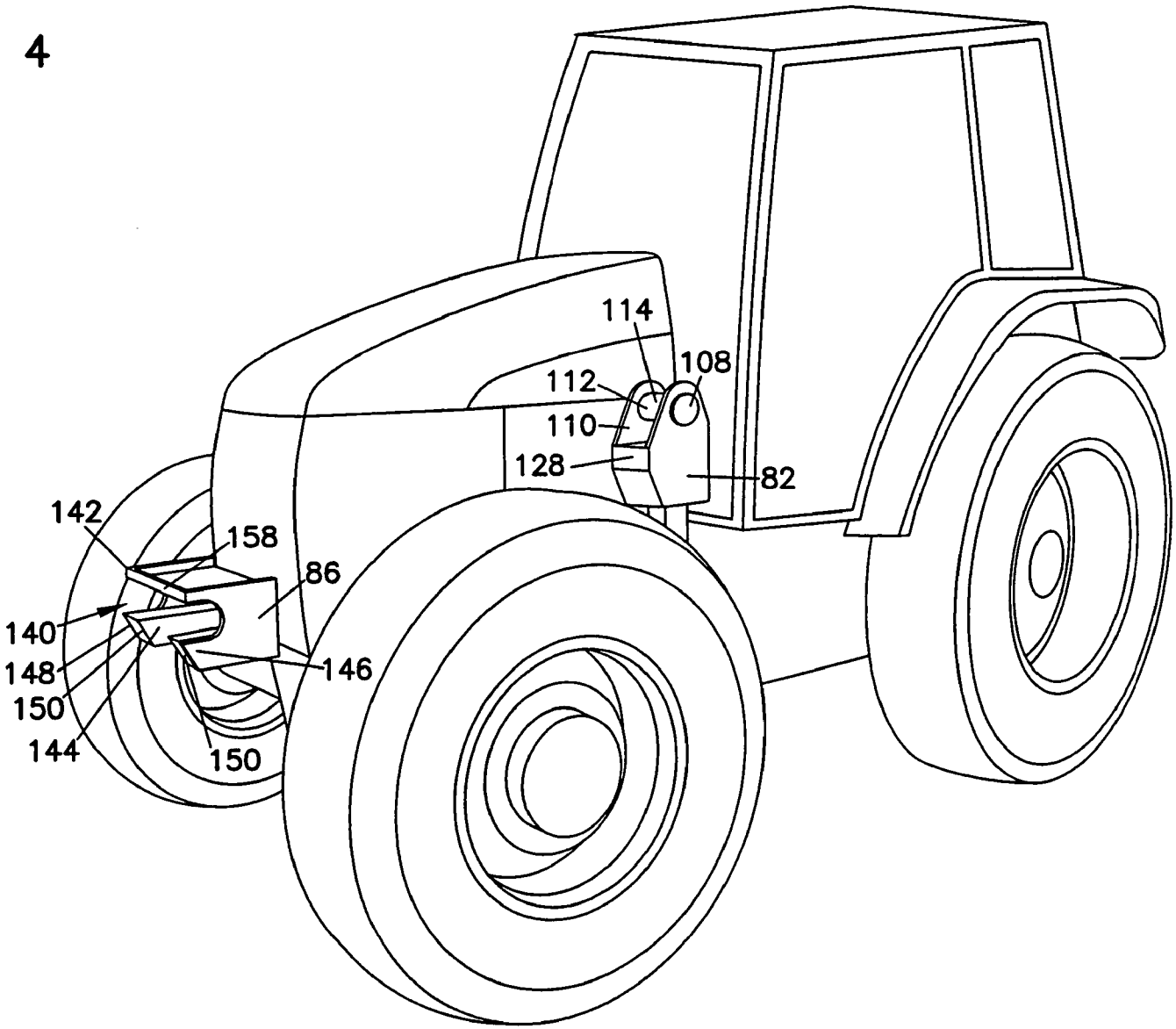
FIG. 4 is a perspective view of the tractor of FIG. 1 showing the front bracket and the left side bracket.
Figure 7:
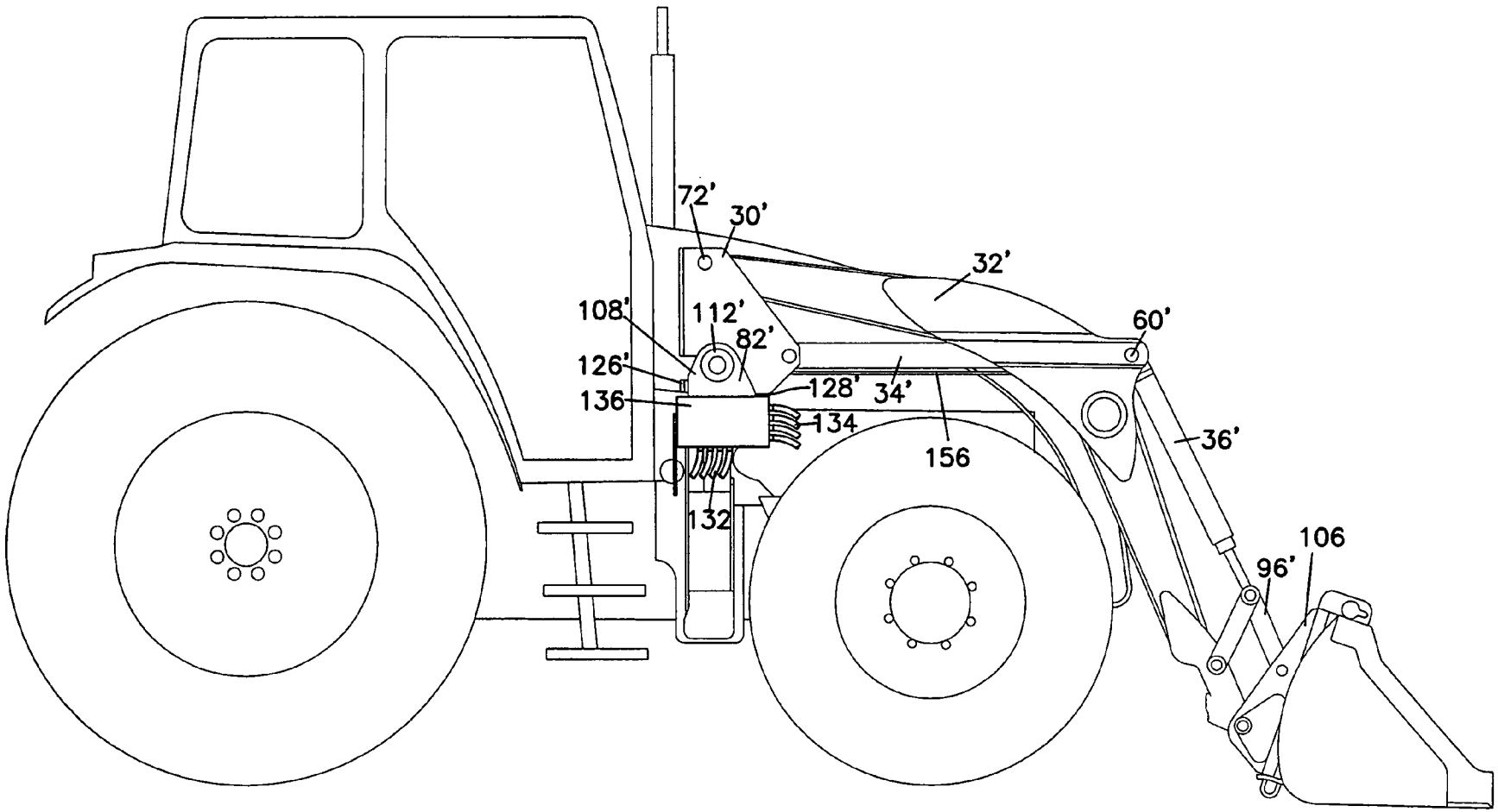
FIG. 7 is a right side view of the loader assembly on a tractor of FIG. 1.

Now referring to FIGS. 4 and 7, the left side bracket 82, the right side bracket 82', and the front bracket 86 are shown attached to the tractor 12. The left side bracket 82 includes a first arm 108, a second arm 110, and a bracket member 112 extending between the first arm 108 and the second arm 110. The bracket member 112 can be provided in the form of a bracket pipe 114. The left side bracket 82 can include a bracket front side 128 that extends between the first arm 108 and the second arm 110.

Figure 5:
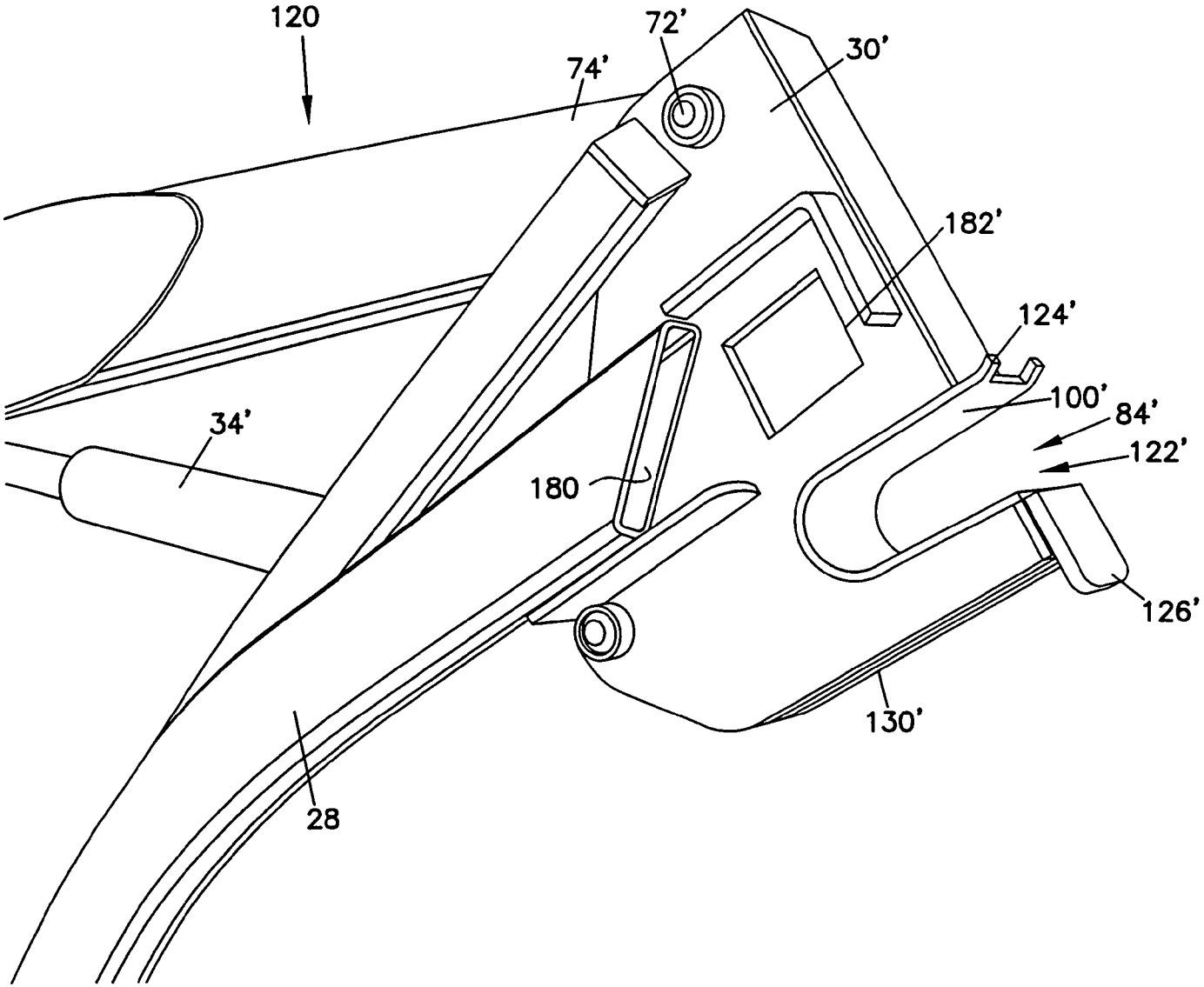
FIG. 5 is a perspective view of a portion of the loader assembly of FIG. 1 shown in a storage position awaiting attachment to the tractor.

Now referring to FIG. 5, a portion of the front end loader 10 is shown wherein the front end loader 10 is provided in a storage position 120. That is, the attachment 14 and the tower subframe support 44 are resting on the ground, and the tower 30' is provided in a position ready for attachment to the right side bracket 82'. It should be understood that the tower 30' is shown with the hydraulic lines removed for illustrative purposes. A step in attaching the loader assembly 10 to the tractor 12 includes driving the tractor 12 forward until the bracket hook bar 126' catches the bracket front side 128'. The bracket hook bar 126' extends beyond or below the tower bottom surface 130'. The amount of the extension should be sufficient to allow the bracket hook bar 126' to extend over and hook onto the bracket front side 128'. Once the bracket hook bar 126' catches the bracket front side 128', the tractor hydraulic lines 132 and the loader hydraulic lines 134 can be attached together. As shown in FIG. 7, the attachment can be provided at the hydraulic line attachment device 136 that is disclosed in U.S. application Ser. No. 10/773,566 that was filed with the United States Patent and Trademark Office on Feb. 6, 2004, the entire disclosure of which is incorporated herein by reference.

Once the hydraulic lines are connected between the tractor 12 and the loader assembly 10, the operator can retract the lift cylinders 34 and 34' so that the loader assembly 10 attaches to the left side bracket 82, the right side bracket 82' and the front bracket 86. As the lift cylinders 34 and 34' retract, the bracket member 112' engages the bracket receiving area 84'. The bracket receiving area 84' can be characterized as the tower shoe area 122'. As the lift cylinders 34 and 34' retract, the bracket member 112' is guided into the tower shoe area 122' by the guides 124'. As the tower shoe area 122' continues over the bracket member 112', the bracket hook bar 126' extends tower the back of the right side bracket 82'. In addition as the lift cylinders 34 and 34' retract, the tower subframe mounting arm 46 becomes received within the front bracket slot 140. As shown in FIG. 4, the front bracket 86 includes a top bracket member 142 and a bottom bracket member 144. The bottom bracket member 144 is shown as a left bracket arm 146 and a right bracket arm 148 but it should be understood that they can be provided as a single structure. The bottom bracket member 144 includes a beveled front surface 150 that allows the tower subframe mounting arm 46 to move therealong until it engages the front bracket slot 140 and is received therein. Once the tower subframe mounting arm 46 is received within the front bracket slot 140, the bracket locking assembly 48 engages the top bracket member 142 to lock the loader assembly 10 in place on the tractor 12.

Figure 6:
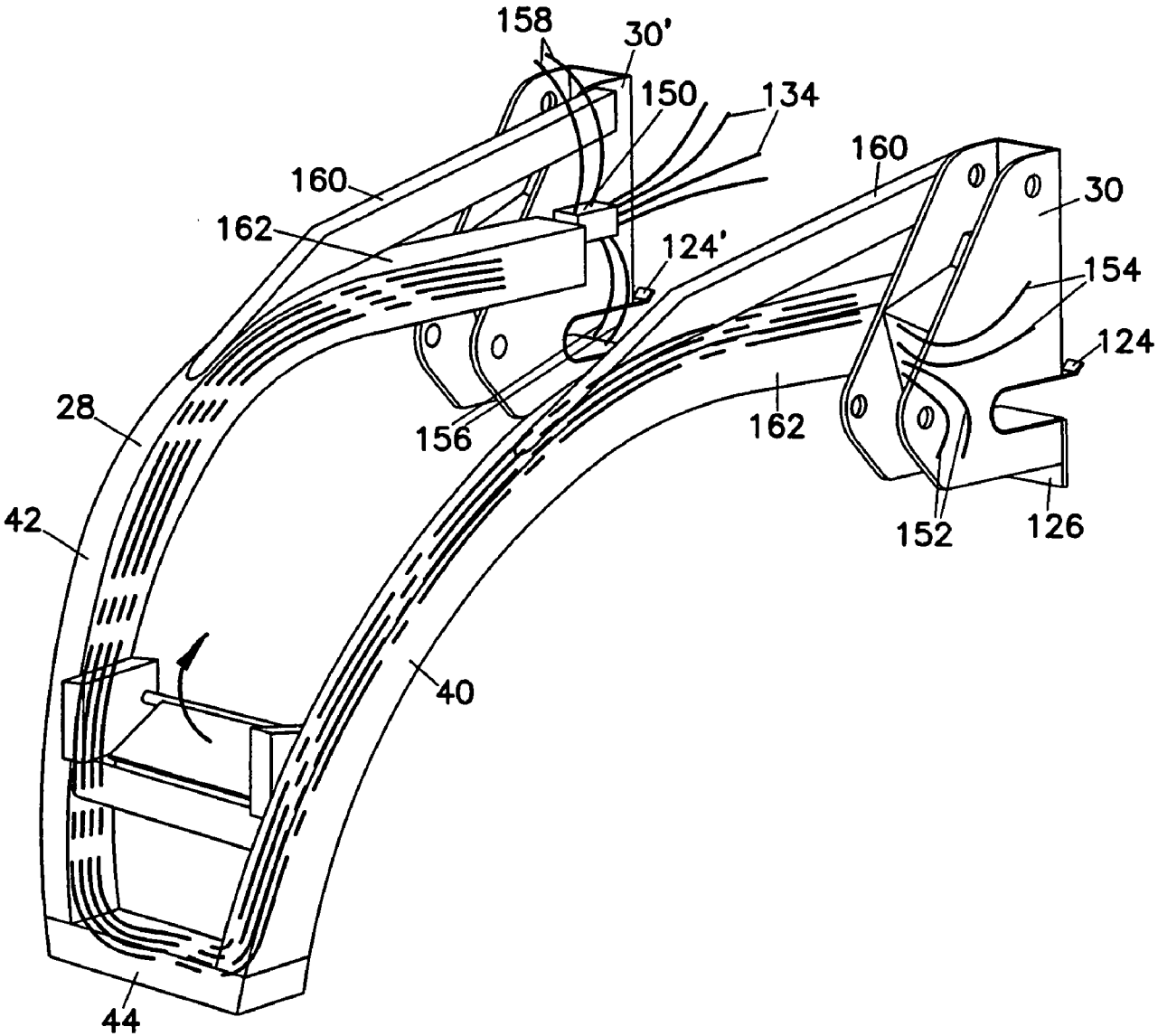
FIG. 6 is a perspective view of the tower and tower assembly of the loader assembly showing the hydraulic lines extending therethrough.

In order to hold the tower subframe mounting arm 46 in place in the front bracket slot 140, the front bracket locking assembly 48 can be rotated down into a locking position as shown in FIG. 2. The front bracket locking assembly 48 includes a rotation member 152 and a front bracket engaging member 154. The front bracket engaging member 154 can be provided as a latch plate 156. As the latch plate 156 rotates, it engages the lip 158 on the top bracket member 142. It is expected that the front bracket locking assembly 48 can automatically lock the tower subframe mounting arm 46 in place within the front bracket 86. That is, as the tower subframe mounting arm 46 is received within the front bracket slot 140, the top bracket member 142 causes the latch plate 56 to rotate according to the arrow as shown in FIGS. 2 and 6 so that it rotates out of the way until the tower subframe mounting arm 46 is sufficiently received within the bracket slot 140. At that time, the latch plate 156 falls into place engaging the lip 158 as a result of the forces of gravity. In order to unlock the tower subframe mounting arm 46 from the front bracket 86, one can rotate the latch plate 156 so that it disengages the lip 158. The latch plate 156 can be rotated in the direction of the arrow shown in FIGS. 2 and 6 in order to disengage the lip 158. The lift cylinders 34 and 34' can be extended in order to remove the tower subframe mounting arm 46 from the front bracket slot 140. Once the attachment and the subframe are resting on the ground, one can detach the hydraulic lines and move the tractor 12 away from the loader assembly 10.

An advantage of the loader assembly 10 is that the hydraulic lines that power the hydraulic cylinders can be generally concealed within the loader assembly 10. That is, by concealing the hydraulic lines within the loader assembly 10, there is less likelihood that the hydraulic lines will become snagged or damaged as result of wear and tear caused by articles contacting the hydraulic lines as is sometimes the case when hydraulic lines extend along the exterior surface of a loader. For example, branches can become wedged between exterior hydraulic lines and a front end loader, and bumping into structures can damage hydraulic lines that extend along the exterior of a front end loader. Several front end loader designs have been developed that attempt to conceal the hydraulic lines within the front end loader. Exemplary United States patent applications that conceal hydraulic lines within the front end loader include U.S. application Ser. No. 10/719,667 and U.S. application Ser. No. 10/719,657 that were filed with the United States Patent and Trademark Office on Nov. 21, 2003. The entire disclosures of U.S. application Ser. No. 10/719,667 and U.S. application Ser. No. 10/719,657 are incorporated herein by reference. It should be understood that the term "concealing" is not intended in an absolute sense. That is, it is expected that one inspecting the loader assembly may see hydraulic lines at certain locations, such as, when the lines are attached to hydraulic cylinders. For the most part, however, the hydraulic lines extend within the loader assembly so that they are protected and are generally not visible to the extent hydraulic lines extending along the exterior of a loader are visible.

One technique for concealing the hydraulic lines within the loader assembly 10 is shown in FIG. 6. It should be understood that various alternative arrangements for concealing the hydraulic lines within the front end loader can be provided according to the invention. As shown in FIG. 6, the loader hydraulic lines 134 can enter a tee area 150 where the lines can be split to provide four sets of lines for operating the hydraulic cylinders on the front end loader. The four sets of lines can include left lift cylinder hydraulic lines 152, left attachment cylinder hydraulic lines 154, right lift cylinder hydraulic lines 156, and right attachment cylinder hydraulic lines 158. It should be understood that hydraulic cylinders are operated based upon two lines where hydraulic fluid flows in via one line and out via the other line in order to power the hydraulic cylinder to provide extension and retraction. As shown, the left lift cylinder hydraulic lines 152 and the left attachment cylinder hydraulic lines 154 extend through the tower subframe 28. In particular, the hydraulic lines extend through the right tower subframe arm 42, the tower subframe support 44, and the left tower subframe arm 40. The left lift cylinder hydraulic lines 152 and the right lift cylinder hydraulic lines 156 can extend through the towers 30 and 30' to power the lift cylinders 34 and 34'. The left attachment cylinder hydraulic lines 154 and the right attachment cylinder hydraulic lines 158 can extend through the towers 30 and 30' and through the loader arms 32 and 32' to power the attachment cylinders 36 and 36'.

The loader hydraulic lines 134 enter the tee area 150 and are split. One set of hydraulic lines extends through the tower subframe 28 via the tower subframe opening 180 as shown in FIG. 5. The second set of hydraulic lines enters the tower 30' via the tower opening 182'. The hydraulic lines extending through the tower subframe 28 enter the tower 30 via a similar opening (not shown). It should be understood that the configuration of the opening 182' can be provided to help hold the tees in place within the tee area 150.

The tower subframe 28 is shown where the left tower subframe arm 40 and the right tower subframe arm 42 provide an upper arm 160 and a lower arm 162. It should be understood that a single arm can be provided for attachment to the towers 30 and 30'. It is expected that utilizing an upper arm 160 and a lower arm 162 will provide additional support.

The lift cylinders and the attachment cylinders that can be used according to the invention include hydraulic cylinders that are commonly available, the hydraulic cylinders disclosed in U.S. application Ser. No. 10/719,667 that was filed with the United States Patent and Trademark Office on Nov. 21, 2003, and hydraulic cylinders disclosed herein. It should be understood that the entire disclosure relating to hydraulic cylinders provided in U.S. application Ser. No. 10/719,667 is incorporated herein by reference.

Figure 8:
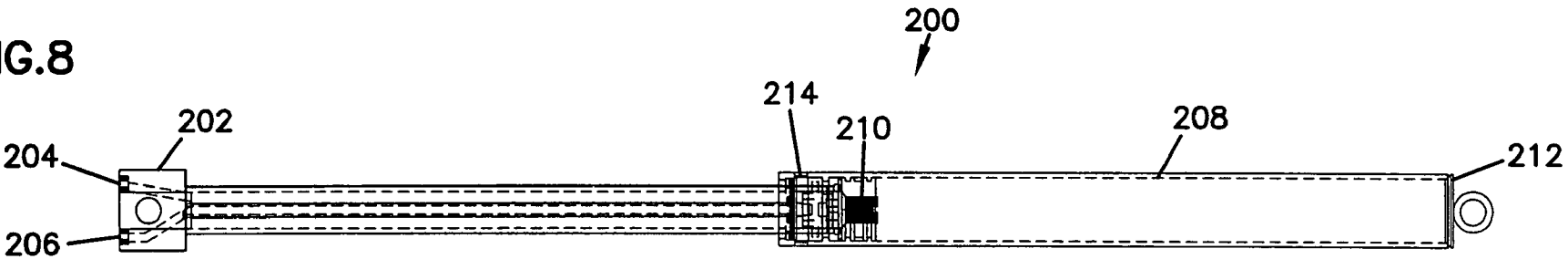
FIGS. 8-11 are schematic views of hydraulic cylinders according to the principles of the present invention.

Now referring to FIG. 8, a hydraulic cylinder that can be used according to the invention is shown at reference number 200. The hydraulic cylinder 200 is similar to a hydraulic cylinder disclosed in U.S. application Ser. No. 10/719,667 except that the porting is different. The hydraulic cylinder 200 can be ported through the end cap 202 having a first hydraulic line inlet/outlet port 204 and a second hydraulic line inlet/outlet port 206. One of the inlet/outlet ports is responsible for flooding the cylinder barrel 208 between the piston 210 and the end cap 212, and the other inlet/outlet is responsible for flooding the cylinder barrel 208 between the piston 210 and the gland 214.

Figure 9:
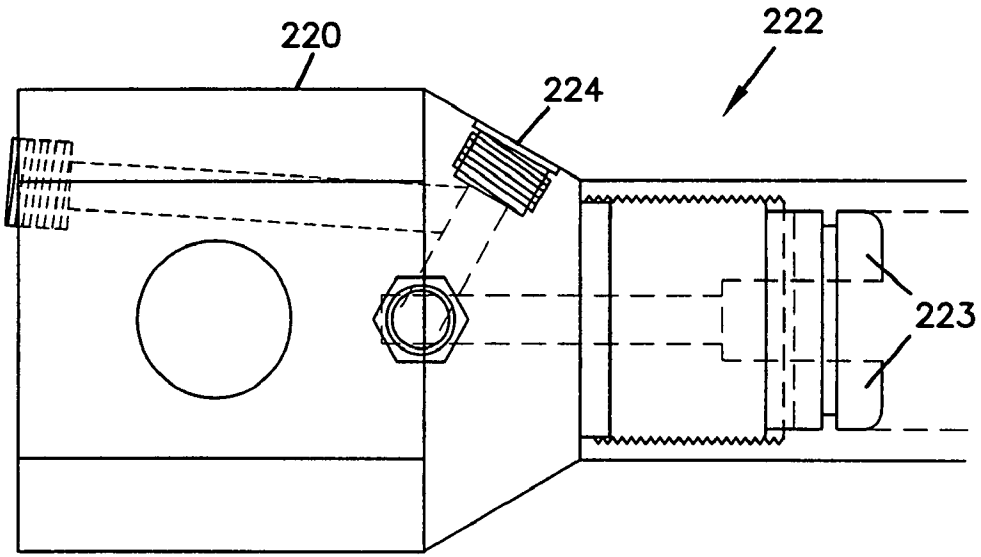

Now referring to FIG. 9, an alternative end cap 220 is provided having an internal tee 222. That is, two first hydraulic line inlet/outlet ports 224 are provided (only one is shown because the other is immediately behind it), and two second hydraulic line inlet/outlet ports 226 are provided.

Figure 10:
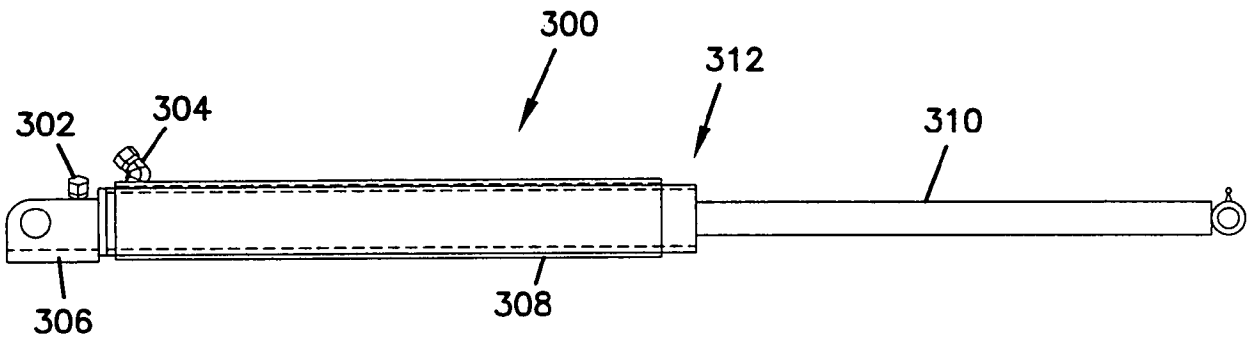

Now referring to FIG. 10, an alternative hydraulic cylinder is shown at reference number 300. The hydraulic cylinder 300 includes a first hydraulic line inlet/outlet port 302 and a second hydraulic line inlet/outlet port 304. The first hydraulic line inlet/outlet port 302 is provided in the cap 306, and the second hydraulic line inlet/outlet is provided in the cylinder barrel 308. The hydraulic cylinder 300 can be assembled by introducing the piston and the ram 310 through the gland end 312, and then attaching the gland in place. It should be understood that the techniques and structures for porting hydraulic cylinders at one end are described in U.S. application Ser. No. 10/719,667, and the disclosure of those hydraulic cylinders is incorporated herein by reference.

Figure 11:
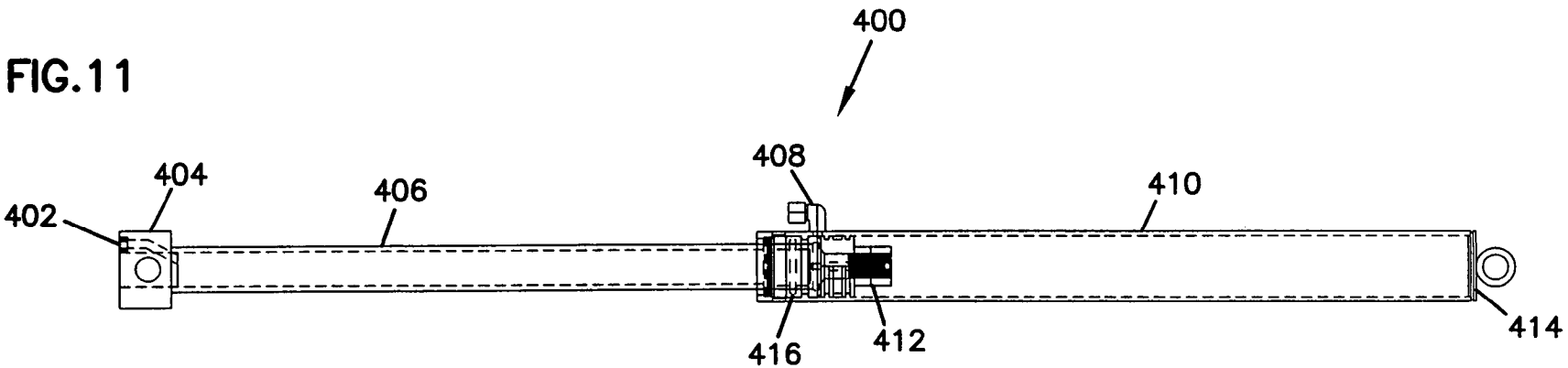

Now referring to FIG. 11, an alternative hydraulic cylinder is shown at reference number 400. The hydraulic cylinder 400 includes a first hydraulic line inlet/outlet port 402 in the cap 404 on the ram 406. The hydraulic cylinder 400 includes a second hydraulic line inlet/outlet port 408 in the cylinder barrel 410. The hydraulic line inlet/outlet port 402 provides hydraulic fluid through the ram 406 and into the barrel 410, and the hydraulic fluid can be provided either between the piston 412 and the end cap 414 or between the piston 412 and the gland 416. The second hydraulic line inlet/outlet port 408 can provide hydraulic fluid to the region not supplied by the first hydraulic line inlet/outlet port 404.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A loader assembly comprising:

(a) a left boom arm comprising:

(i) a left tower constructed for attachment to a bracket on a motor vehicle;

(ii) a left loader arm comprising a first end rotatably attached to the left tower, a second end constructed for attaching to an attachment;

(iii) a left lift cylinder comprising a first end rotatably attached to the left tower, and a second end rotatably attached to the left loader arm, wherein the left lift cylinder extends through the left loader arm; and (iv) a left attachment cylinder comprising a first end rotatably attached to the left loader arm, and a second end constructed for attaching to an attachment; and (b) a right boom arm comprising:

(i) a right tower constructed for attachment to a bracket on a motor vehicle;

(ii) a right loader arm comprising a first end rotatably attached to the right tower, a second end constructed for attaching to an attachment;

(iii) a right lift cylinder comprising a first end rotatably attached to the right tower, and a second end rotatably attached to the right loader arm, wherein the right lift cylinder extends through the right loader arm; and (iv) a right attachment cylinder comprising a first end rotatably attached to the right loader arm, and a second end constructed for attaching to an attachment.

2. A loader assembly comprising:

(a) a left boom arm comprising a left tower constructed for attaching to a bracket on a tractor, and a left loader arm comprising a first end rotatably attached to the left tower and a second end constructed for attaching to an attachment;

(b) a right boom arm comprising a right tower constructed for attaching to a bracket on a tractor, and a right loader arm comprising a first end rotatably attached to the right tower and a second end constructed for attaching to an attachment; and (c) a tower subframe extending between the left tower and the right tower, the tower subframe containing a plurality of hydraulic lines therein extending therethrough from the left tower to the right tower or from the right tower to the left tower.

* * * * *